United States Patent [19]

Cha

[11] 4,378,841

[45] Apr. 5, 1983

[54] IGNITION TECHNIQUE FOR AN IN SITU OIL SHALE RETORT

[75] Inventor: Chang Y. Cha, Golden, Colo.

[73] Assignee: Occidental Oil Shale, Inc., Grand Junction, Colo.

[21] Appl. No.: 220,787

[22] Filed: Dec. 29, 1980

[51] Int. Cl.[3] ..... E21B 43/243

[52] U.S. Cl. ..... 166/261; 299/2

[58] Field of Search ..... 166/259–261; 299/2

[56] References Cited

U.S. PATENT DOCUMENTS

| | | | |
|---|---|---|---|
| 3,952,801 | 4/1976 | Burton | 166/256 |
| 3,990,835 | 11/1976 | Burton | 431/353 |
| 4,027,917 | 6/1977 | Bartel | 299/2 |
| 4,133,380 | 1/1979 | Burton et al. | 166/259 |
| 4,192,552 | 3/1980 | Cha | 299/2 |
| 4,224,990 | 9/1980 | Cha | 166/259 |
| 4,243,100 | 1/1981 | Cha | 166/259 |
| 4,263,970 | 4/1981 | Cha | 166/261 |

*Primary Examiner*—William F. Pate, III

*Attorney, Agent, or Firm*—Christie, Parker & Hale

[57] ABSTRACT

A generally flat combustion zone is formed across the entire horizontal cross-section of a fragmented permeable mass of formation particles formed in an in situ oil shale retort. The flat combustion zone is formed by either sequentially igniting regions of the surface of the fragmented permeable mass at successively lower elevations or by igniting the entire surface of the fragmented permeable mass and controlling the rate of advance of various portions of the combustion zone.

39 Claims, 1 Drawing Figure

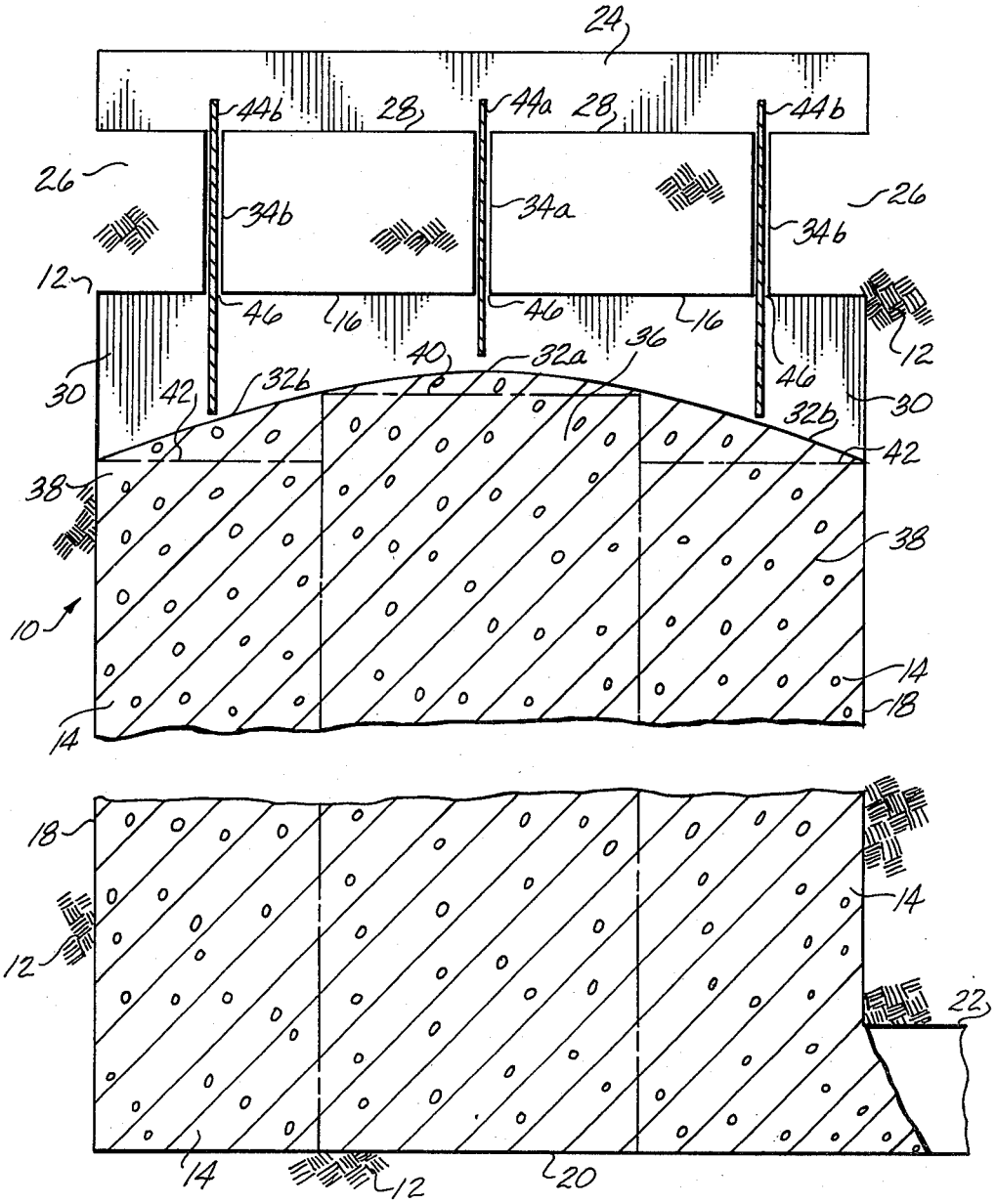
24
44b
28
44a
28
44b
26
34b
34a
34b
26
12
46
16
46
16
46
12
30
42
32b
40
32a
36
32b
30
42
38
38
10
14
18
14
18
14
12
22
14
12
20

IGNITION TECHNIQUE FOR AN IN SITU OIL SHALE RETORT

The Government of the United States of America has rights in this invention pursuant to Cooperative Agreement DE-FC20-78LC10036 awarded by the U.S. Department of Energy.

FIELD OF THE INVENTION

This invention relates to processing of oil shale and, more particularly, to a method for igniting the oil shale in an in situ oil shale retort.

BACKGROUND OF THE INVENTION

The presence of large deposits of oil shale in the Rocky Mountain region of the United States has given rise to extensive efforts to develop methods of recovering shale oil from kerogen in the oil shale deposits. It should be noted that the term "oil shale" as used in the industry is, in fact, a misnomer; it is neither shale nor does it contain oil. It is a sedimentary formation comprising a marlstone deposit with layers containing an organic polymer called "kerogen" which, upon heating, decomposes to produce liquid and gaseous products, including hydrocarbon products. It is the formation containing kerogen that is called "oil shale" herein and the liquid hydrocarbon product is called "shale oil".

A number of methods have been proposed for processing oil shale which involve either mining the kerogen-bearing shale and processing the shale on the surface, or processing the shale in situ. The latter approach is preferable from the standpoint of environmental impact since the spent shale remains in place, reducing the chance of surface contamination and the requirement for disposal of solid wastes. According to both of these approaches, oil shale is retorted by heating the oil shale to a sufficient temperature to decompose kerogen and produce shale oil which drains from the rock. The retorted shale, after kerogen decomposition, contains substantial amounts of residual carbonaceous material which can be burned to supply heat for retorting.

One technique for recovering shale oil includes forming an in situ oil shale retort in a subterranean formation containing oil shale. At least a portion of the formation within the boundaries of the in situ oil shale retort is explosively expanded to form a fragmented permeable mass of particles containing oil shale. The fragmented mass is ignited near the top of the retort to establish a combustion zone. An oxygen-supplying gas is introduced into the top of the retort to sustain the combustion zone and cause it to move downwardly through the fragmented permeable mass of particles in the retort. As burning proceeds, the heat of combustion is transferred to the fragmented mass of particles below the combustion zone to release shale oil and gaseous products therefrom in a retorting zone. The retorting zone moves from top to bottom of the retort ahead of the combustion zone and the resulting shale oil and gaseous products pass to the bottom of the retort for collection and removal. Recovery of liquid and gaseous products from oil shale deposits is described in greater detail in U.S. Pat. No. 3,661,423 to Donald E. Garrett.

In preparation for the described retorting process, it is important that the formation be fragmented and displaced, rather than simply fractured, in order to create high permeability; otherwise, too much pressure differential is required to pass gas through the retort.

It has been found desirable in some embodiments to have an intact subterranean base of operation above the fragmented permeable mass of formation particles in an in situ oil shale retort. Such a base of operation facilitates the drilling of blastholes into underlying formation for forming a fragmented mass in the retort and facilitates ignition over the entire top portion of the fragmented mass. Additionally, having a base of operation above the fragmented permeable mass of formation particles permits control of introduction of oxygen-supplying gas into the retort, provides a location for testing properties of the fragmented permeable mass, such as distribution of void fraction, and provides a location for evaluation and controlling performance of the retort during operation.

The base of operation is separated from the retort by a layer of unfragmented formation extending between the top boundary of the retort and the floor of such a base of operation. The layer of unfragmented formation is termed a "sill pillar" which acts as a barrier between the in situ oil shale retort and the base of operation during retorting operations. It is, therefore, important that the sill pillar remain structurally sound, both for supporting the base of operation and for preventing entry of heat and gases into the base of operation during the retorting process.

Techniques for forming an in situ oil shale retort containing a fragmented permeable mass of formation particles and having a sill pillar of unfragmented formation between the top of the fragmented mass and an overlying base of operation are described in U.S. Pat. No. 4,118,071 by Ned M. Hutchins and in application Ser. No. 929,250 filed July 31, 1978, by Thomas E. Ricketts, entitled "Method for Explosive Expansion Toward Horizontal Free Faces for Forming an In Situ Oil Shale Retort". Now U.S. Patent No. 4,192,554 and application Ser. No. 929,250 are incorporated herein by this reference. An in situ oil shale retort formed by the method disclosed in application Ser. No. 929,250 may not be completely full of oil shale particles, i.e., there can be a void space between the upper surface of the fragmented mass of oil shale particles and the top boundary of the retort.

In other embodiments, the formation overlying the fragmented permeable mass of formation particles extends all the way to the ground surface. In such an embodiment, blastholes are drilled through the overlying formation and ignition of the fragmented mass of particles is accomplished from the ground surface. Alternatively, drifts can be excavated through unfragmented formation above a retort to provide access during forming, igniting, and/or operating the retort.

In the past, a variety of techniques have been developed for igniting oil shale particles in an in situ oil shale retort in order to establish a combustion zone. Such techniques are disclosed in U.S. Pat. No. 4,027,917 and U.S. Pat. No. 3,952,801, both by Robert S. Burton, III. According to the techniques disclosed in these patents, a hole is bored to the top of the fragmented permeable mass and a burner is lowered through the borehole to the oil shale to be ignited. A mixture of combustible fuel, such as LPG (liquefied petroleum gas), diesel oil, or shale oil, and oxygen-containing gas, such as air, is burned in the burner and the resultant flame is directed downwardly toward the fragmented permeable mass. The burning is conducted until a substantial portion of the oil shale has been heated above its ignition temperature so that combustion of the oil shale in the fragmented mass is self-sustaining after ignition. Thereafter, oxygen-supplying gas is introduced to the retort to advance the combustion zone through the fragmented mass.

When a retort is formed having a void over the top of the fragmented permeable mass, it is important to ensure that portions of overlying unfragmented formation do not slough into the retort. Sloughing of material from unfragmented formation is increased as the temperature of such unfragmented formation is increased.

When material sloughs into the retort, the time required to ignite such a retort is significantly increased. This results in additional fuel usage, thereby increasing the cost of retorting.

Additionally, when a retort is formed having a sill pillar of unfragmented formation above such a fragmented permeable mass of formation particles, sloughing can cause deterioration of the sill pillar's structural integrity and/or complete structural failure. When a sill pillar fails, gases and heat from the retorting operation can escape into the base of operation, rendering the base of operation uninhabitable, thereby increasing the cost of such retorting operations substantially.

Therefore, during the ignition process, it can be important to minimize heating of the bottom of unfragmented formation overlying the fragmented mass in the retort.

It has been found that in some embodiments, when an in situ oil shale retort is formed which has a void space between the upper surface of the fragmented permeable mass of formation particles and the top boundary, the upper surface of the fragmented permeable mass is not flat, but is shaped like a dome. For example, the surface of the fragmented permeable mass of formation particles in the center region of the retort is at a higher elevation than the surface of the fragmented permeable mass of formation particles at about the side boundaries of the retort.

When a combustion zone is formed across the surface of such a dome shaped fragmented permeable mass, the combustion zone tends to take on the shape of the dome.

When the combustion zone formed is not flat in a horizontal plane across the retort, but is dome shaped, the yield of liquid and gaseous hydrocarbon products from the retort tends to be reduced.

This occurs because shale oil produced at a higher elevation in the in situ oil shale retort can be consumed by a portion of the combustion zone located below the higher elevation as products of retorting flow downwardly into such a combustion zone.

Therefore, in order to enhance the economics of the process, it is important to form a combustion zone that is flat in a horizontal plane across the retort.

It is also found that when a combustion zone is formed which does not extend completely across the entire horizontal extent of the fragmented permeable mass of formation particles, the yield of liquid and gaseous hydrocarbon products from oil shale is reduced. This occurs because the oil shale in upper corners and/or near the side edges of the retort are bypassed by such a combustion zone and, therefore, recovery of shale oil is not achieved from the entire fragmented mass of oil shale particles.

In summary, it has been found desirable that an ignition process be provided for economically reducing sloughing of rock from unfragmented formation overlying an in situ oil shale retort and for establishing a primary combustion zone which extends substantially entirely across the horizontal extent of the retort and is substantially flat in a horizontal plane.

SUMMARY OF THE INVENTION

This invention provides a method for igniting a fragmented permeable mass of formation particles containing oil shale in an in situ oil shale retort. The in situ oil shale retort is formed in a subterranean formation containing oil shale and has a top boundary of overlying unfragmented formation. The top surface of the fragmented permeable mass has an upper elevation region above a first region of the fragmented permeable mass and a lower elevation region above a second region of the fragmented permeable mass.

In one embodiment, a combustion zone is established at about the top surface of the first region of the fragmented permeable mass of formation particles located at a first elevation in the retort. A retort inlet mixture is introduced into the retort for advancing the combustion zone downwardly through the first region of the fragmented permeable mass to a second elevation in the retort. The top surface of the second region of the fragmented permeable mass of formation particles is then ignited for spreading the combustion zone laterally across the fragmented mass of formation particles at about the second elevation in the retort.

Alternatively, a primary combustion zone is established across the entire top surface of the fragmented permeable mass. The combustion zone is then advanced downwardly through the fragmented mass at a relatively faster rate below the upper elevation region and is advanced downwardly through the fragmented mass at a relatively slower rate below the lower elevation region. This is continued until a reasonably flat horizontally extending primary combustion zone is established in the fragmented mass.

BRIEF DESCRIPTION OF THE DRAWING

These and other features, aspects, and advantages of the present invention will become more apparent when considered in respect to the following description, appended claims, and accompanying drawing, wherein the drawing illustrates, semi-schematically, a vertical cross-section of an in situ oil shale retort operated in accordance with practice of principles of this invention.

DETAILED DESCRIPTION

Referring to the accompanying drawing, there is shown a semi-schematic vertical cross-sectional view of an in situ oil shale retort 10 formed in a subterranean formation 12 containing oil shale. The in situ oil shale retort contains a fragmented permeable mass of formation particles 14 containing oil shale. The retort is bounded by a top boundary 16, generally vertically extending side boundaries 18, and a bottom boundary 20 of unfragmented oil shale formation. The retort has a generally rectangular horizontal cross-section. Access to the bottom of the in situ oil shale retort is provided through a horizontal access drift or tunnel 22 at the bottom of the retort. In one embodiment, the tunnel 22 is first formed in the subterranean oil shale formation and a portion of the shale is then removed through the tunnel to form an open space in the formation. The open space defines the bottom boundary or floor of the in situ oil shale retort. Oil shale above this open space is then fragmented with explosive, both to form a cavity defined by the boundaries of the retort and to substantially fill the cavity with a fragmented permeable mass of oil shale particles.

The average void fraction of the fragmented permeable mass of oil shale particles formed is preferred to be between about 15% and about 35%.

In an exemplary embodiment, there is also provided an open base of operation 24 mined into the subterranean formation which extends across the in situ retort. The base of operation provides effective access to substantially the entire horizontal extent of such a retort.

A sill pillar 26 of unfragmented formation remains between the fragmented permeable mass of oil shale particles and the open base of operation 24. The top 28 of the sill pillar is the floor of the base of operation and the bottom of the sill pillar is the top boundary 16 of the retort.

In an exemplary embodiment, there is a void space 30 remaining between the upper surface 32 of the fragmented permeable mass of formation particles and the bottom of the sill pillar after explosive expansion of the oil shale during formation of the retort.

Passages, i.e., boreholes 34, are formed from the base of operation through the sill pillar 26 and into the void space 30. These passages can provide for introduction of fluids, such as air or mixtures of air and fuel, from the base of operation into the fragmented permeable mass of formation particles in the retort.

When there is no open base of operation provided, the boreholes can be formed through overlying unfragmented formation from the ground surface.

It has been found that the top surface of the fragmented permeable mass of formation particles in an in situ oil shale retort is not necessarily flat in a horizontal plane across the retort. The top surface of the fragmented permeable mass can be at a higher elevation in one region of the retort and at a lower elevation in other regions.

For example, the top surface 32 of the fragmented permeable mass 14 of formation particles formed in the retort 10 has a shape generally in the form of a dome. The top surface 32 of the fragmented permeable mass has an upper elevation region **32*a* in a center region of the retort and a lower elevation region 32*b*** in an outer region of the retort at about the side boundaries of the retort.

Additional details of techniques used for forming in situ oil shale retorts can be found in application Ser. No. 929,250 and in U.S. Pat. No. 3,661,423, both incorporated hereinabove by reference. Also, U.S. Pat. No. 4,043,595 by French; U.S. Pat. No. 4,043,596 by Ridley; U.S. Pat. No. 4,043,597 by French; and U.S. Pat. No. 4,043,598 by French et al describe methods of forming in situ oil shale retorts and are incorporated herein by this reference.

After the retort is formed, retorting of the fragmented permeable mass of oil shale particles is initiated by establishing a primary combustion zone in the fragmented mass. The primary combustion zone is thereafter sustained and advanced through the retort by introducing a retort inlet mixture comprising an oxygen-supplying gas into the retort on the trailing side of the combustion zone. The retort inlet mixture can be introduced through at least one of the passages formed through the sill pillar.

Hot gases pass through the primary combustion zone and cause retorting of oil shale in a retorting zone on the advancing side of the combustion zone. An off gas containing gaseous products of retorting and unreacted components of the retort inlet mixture, as well as liquid products, are withdrawn from the retort on the advancing side of the retorting zone through the access drift 22.

As used herein, the term "retorting zone" refers to that portion of the retort where kerogen in oil shale is being decomposed to liquid and gaseous products, leaving residual carbonaceous material in the retorted oil shale.

The term "primary combustion zone" refers to a portion of the retort where the greater part of the oxygen in a retort inlet mixture that reacts with the residual carbonaceous material in the retorted oil shale is consumed.

By practice of principles of this invention, a generally flat primary combustion zone is formed across substantially the entire horizontal extent of the retort 10.

In order to provide for enhanced clarity of description of principles of this invention, the fragmented mass 14 is shown as having two regions segmented by phantom lines. The first region 36 of the fragmented permeable mass is in a center region of the retort. The second region 38 is laterally spaced apart from the first region, surrounds the first region, and extends to the boundaries of the retort.

The top surface of the fragmented permeable mass, although actually dome-shaped, is approximated for exposition herein by the flat horizontal surface 40 of the first region and the flat horizontal surface 42 of the second region. The top surface 40 of the first region is used in this description instead of the upper elevation portion **32*a* and the top surface 42 is used instead of the lower elevation portion 32*b*. The top surface 40 of the first region is at a higher elevation in the retort than the top surface 42** of the second region. Although described as two regions of differing elevations, it will be apparent that the principles are applicable for a fragmented mass considered to be divided into a larger number of regions of differing elevations.

In one exemplary embodiment, the fragmented mass of formation particles is ignited by establishing a combustion zone across the entire top surface of the fragmented mass. The combustion zone is advanced at a relatively faster rate below the top surface 40 of the first region 36 and at a relatively slower rate below the top surface 42 of the second region 38. These faster and slower rates are continued until the combustion zone in the first region "catches up" to the combustion zone in the second region. Once the primary combustion zone in the first region reaches the same elevation in the retort as the primary combustion zone in the second region, the combustion zones form a reasonably flat horizontally extending combustion zone across the entire horizontal cross-section of the retort.

In order to ignite the top surface of the fragmented permeable mass, a combustible mixture of oxygen-supplying gas and fuel is introduced through one or more of the passages 34 formed through the sill pillar of unfragmented formation.

The oxygen-supplying gas can be air, oxygen-enriched air, air diluted with off gas, steam, or the like. The fuel can be propane, butane, natural gas, off gas from an in situ oil shale retort, LPG (liquefied petroleum gas), or other combustible materials such as diesel oil, shale oil, or the like.

The mixture of oxygen-supplying gas and fuel is ignited to form hot ignition gases which are directed downwardly toward the top surface of the fragmented mass.

The hot ignition gas heats the oil shale in the fragmented permeable mass to above the self-ignition temperature of oil shale, thereby forming a primary combustion zone in the retort. The self-ignition temperature of carbonaceous material, such as oil shale, can vary with various conditions, such as the partial pressure of oxygen in the retort. The self-ignition temperature may be as low as 500° F., although 700° F. is usually considered a minimum. During operation of in situ oil shale retorts, it is preferred to consider 900° F. as about the self-ignition temperature of oil shale.

For purposes of illustration, there are three representative passages or boreholes 34 shown extending from the base of operation to the void space 30. The passage 34*a* is located generally above the top surface of the first region of the fragmented mass and the passages 34*b* are located generally above the top surface of the second region of the fragmented mass. A larger number of passages can be used above each region if desired.

To form a primary combustion zone in the first region 36 of the fragmented mass of formation particles, a mixture of LPG and air is introduced through the passage 34*a*. The mixture is ignited and the hot ignition gases are directed downwardly onto the top surface 40 of the first region. The oil shale particles at about the top surface are heated to above their self-ignition temperature, thereby forming a primary combustion zone across the top surface of the first region. Concurrently, a mixture of LPG and air is introduced through both the passages designated 34*b*. These mixtures are ignited and the hot ignition gases are directed downwardly onto the top surface 42 of the fragmented permeable mass of the second region. The oil shale particles at the top surface of the second region are heated to above their self-ignition temperature, thereby forming a primary combustion zone across the top surface of the second region.

In this exemplary embodiment, a primary combustion zone, therefore, has been formed across the entire top surface of the fragmented mass of formation particles.

When the entire top surface of the fragmented permeable mass has been ignited, the combustion zone is not flat in a plane across the horizontal extent of the retort. Instead, the combustion zone is located at a higher elevation across the top surface 40 of the fragmented permeable mass of the first region and is at a lower elevation across the top surface 42 of the fragmented permeable mass of the second region.

During ignition of a retort and during retorting operations, it is desirable that the temperature of unfragmented formation overlying the fragmented permeable mass, i.e., the bottom 16 of the sill pillar 26, be maintained at a temperature below the temperature at which sloughing of unfragmented formation is enhanced. It has been found that sloughing is enhanced if the temperature of unfragmented formation is increased to above about 300° F.

When fuel and an oxygen-supplying gas are injected directly through the passages 34 and ignited, the flame can be located directly below the exit of the passage. Having a flame at this location can cause undesirable heating of the bottom surface of the sill pillar.

It, therefore, is desired that the flame from ignition of the fuel and oxygen-supplying gas be located some distance from the bottom of the sill pillar.

In an exemplary embodiment, a pipe 44 is extended through each passage 34 with the bottom of the pipe being close to the top surface of the fragmented permeable mass. For example, the bottom of the pipe 44*a* in the borehole 34*a* is close to the top surface 40 of the fragmented permeable mass of the first region 36. The bottom of each pipe 44*b* in each of the boreholes 34*b* is close to the top surface 42 of the fragmented permeable mass of the second region 38.

There is an annular space 46 provided which circumferentially surrounds each pipe 44 between the outer surface of the pipe and the wall of each passage 34.

If desired, a burner can be positioned in each pipe and the fuel and oxygen-supplying gas can be introduced into the burner and ignited for providing the hot ignition gas. The hot ignition gas flows from the end of the burner and thence from the end of the pipe for igniting the top surface of both the first and second regions of the fragmented permeable mass.

Details of burners useful in practice of principles of this invention can be found in U.S. Pat. Nos. 3,952,801 and 3,990,835, both of which are incorporated herein by this reference.

Having the hot ignition gas from combustion exit the end of the pipe near the fragmented permeable mass at a location spaced apart from the overlying unfragmented formation helps to maintain the surface of such overlying unfragmented formation below the temperature at which sloughing occurs.

The flow pattern of ignition gas from the end of the pipe can be such that a stagnant zone can be formed around the pipe near the bottom of the sill pillar. In order to eliminate this stagnant zone, air or other fluids such as inert gas or steam can be introduced through the annular space 46. The air or other fluid flows downwardly through the annulus into the void space 30 above the fragmented mass, thereby avoiding accumulation of gas pockets which could form a combustible or explosive mixture between the top of the fragmented mass and the bottom of the sill pillar. Additionally, the air or other fluid introduced through the annulus provides cooling for the bottom surface of the sill pillar as it flows outwardly from the opening at the bottom of the passage and laterally across the retort.

After the combustion zone is established across the entire fragmented permeable mass at both the surface of the first and second regions, fuel to the burners is discontinued. Introduction of oxygen-supplying gas, however, is continued through the passages 34 for advancing the primary combustion zone through the retort.

In this embodiment, a reasonably flat horizontally extending primary combustion zone is established across the entire horizontal cross-section of the retort by advancing the primary combustion zone formed at the top surface of the first region at a faster rate than the primary combustion zone formed at the top surface of the second region.

This can be accomplished by forming a secondary combustion zone upstream from the primary combustion zone in the second region of the fragmented permeable mass.

The secondary combustion zone is formed by introducing a mixture of fuel and air into the fragmented mass through the passage 34*b* leading to the second region. The mixture of fuel and air passes into the fragmented permeable mass of the second region and ignites at a location in the second region upstream from the primary combustion zone where the temperature of the fragmented mass is at about the ignition temperature of the fuel/air mixture. The term "secondary combustion zone" as used herein refers to that portion of the fragmented mass of formation particles where fuel in a retort inlet mixture is consumed.

U.S. patent application Ser. No. 930,022 titled Process for Recovering Carbonaceous Valves from In Situ Oil Shale Retorting filed by me on Aug. 1, 1978 now U.S. Pat. No. 4,191,251 provides additional details relating to establishment and maintenance of secondary combustion zones in an in situ oil shale retort and is incorporated herein by reference.

Oxygen in the retort inlet mixture which is being introduced through the passage **34*b*** and which flows into the secondary combustion zone is consumed at least partly by ignition of the fuel in such a secondary combustion zone. Therefore, the amount of oxygen flowing from the secondary combustion zone downstream into the primary combustion zone formed in the second region is reduced. If desired, the fuel/air mixture can be provided so that all of the oxygen introduced into the fragmented mass of the second region is consumed in a secondary combustion zone. Therefore, by controlling the amount of fuel and air introduced into the second region, the rate of advance of the primary combustion zone located downstream of the secondary combustion zone in the second region can be regulated as desired.

In this embodiment, there is no secondary combustion zone formed upstream from the primary combustion zone in the first region, and the primary combustion zone advances downwardly through the first region more rapidly than does the primary combustion zone formed in the second region.

After a sufficient period of time, the primary combustion zone which was initially at the top surface of the first region will have advanced to the elevation in the retort at which the primary combustion zone formed in the second region is located.

The primary combustion zones in the first and second regions thereby form a primary combustion zone which extends in a reasonably horizontal plane across the entire extent of the retort.

At this time, fuel being introduced through the passages **34*b*** for forming the secondary combustion zone in the second region of the retort is discontinued. Oxygen-supplying gas, however, is continued to the retort for advancing the primary combustion zone downwardly through the retort during the remainder of retorting operations.

If desired, after the initial heating of the surface of both the first and second regions and after a sufficient portion of the oil shale in both the first and second regions has been heated to above its self-ignition temperature, a secondary combustion zone can be formed in both regions. The secondary combustion zone is formed upstream of the primary combustion zone in the first region and upstream of the primary combustion zone in the second region for spreading the primary combustion zone laterally across the entire top surface of both the first and second regions. In this embodiment, after the primary combustion zone has spread substantially across both the first and second regions, i.e., across the entire top surface of the fragmented permeable mass, the secondary combustion zone can be extinguished in the first region by discontinuing the fuel through the passage **34*a*** while maintaining the secondary combustion zone in the second region. By this method then, the secondary combustion zone is used both to spread the primary combustion zone across each of the regions and thereafter to regulate the advance of the primary combustion zone in the second region in order to form a flat horizontal combustion zone across both the first and second regions of the retort.

In another exemplary embodiment, the retort is ignited by igniting a combustion zone in the upper elevation region **32*a* of the top surface of the fragmented mass and advancing the combustion zone downwardly from the upper region. The combustion zone is thereafter spread laterally across the lower elevation region 32*b*** of the top surface for establishing a generally horizontally extending combustion zone across substantially the entire horizontal cross-section of the fragmented mass. Although the top surface has been described as having only two regions, the top surface can be considered as divided into any number of regions and the retort can be ignited by successively igniting the top surface of the fragmented mass at successively lower elevations in the retort.

Once again, to more clearly describe the principles of this invention, the fragmented mass 14 is shown as having two regions 36 and 38.

In this second embodiment, a primary combustion zone is initially formed at about the top surface 40 of the first region 36 of the fragmented permeable mass. This primary combustion zone is then advanced downwardly through the first region until it reaches the elevation of the top surface 42 of the second region. The primary combustion zone is then spread across the top surface of the second region for establishing a generally horizontally extending primary combustion zone across substantially the entire horizontal cross-section of the retort.

In this embodiment, fuel and an oxygen-supplying gas are introduced into a burner installed in the pipe **44*a* in the borehole 34*a***. For example LPG and air are introduced into the burner and the fuel/air mixture is ignited to provide the hot ignition gas. The hot ignition gas is directed downwardly onto the top surface of the fragmented permeable mass of the first region. Portions of the fragmented permeable mass at about the top surface are heated to above the self-ignition temperature of oil shale for providing a primary combustion zone across the top surface of the first region.

If desired, a secondary combustion zone can be used to enhance the spread of the primary combustion zone across a top surface 40 of the first region 36.

For example, fuel can be discontinued to the burner, thereby extinguishing the burner flame and thereafter a mixture of fuel and oxygen-supplying gas is introduced through the pipe **44*a*** and into the fragmented permeable mass of the first region for forming a secondary combustion zone as described above. The secondary combustion zone spreads laterally across the entire top portion of the first region, thereby heating oil shale to above its self-ignition temperature as it spreads. This causes the primary combustion zone to spread substantially uniformly across the entire top surface of the fragmented permeable mass of the first region.

Additionally, a cooling fluid such as air or steam can be introduced into the second region of the fragmented permeable mass through the pipes **44*b* which are inserted through passages 34*b***. The cooling fluid inhibits undesirable lateral spreading of the combustion zone from the first region into the second region.

Introduction of oxygen-supplying gas is continued to the first region of the fragmented permeable mass for advancing the primary combustion zone downwardly through the first region until it reaches the elevation of the top surface 42 of the second region of the fragmented permeable mass.

Once the primary combustion zone of the first region is advanced downwardly to this elevation, the primary combustion zone is spread laterally across the top surface 42 of the second region of the retort.

In one embodiment, when the primary combustion zone in the first region has advanced to the elevation of the top surface 42, the cooling gas being introduced through the passages **34*b* is discontinued. Then a mixture of fuel and air is introduced to burners in the pipes 44*b* for providing a hot ignition gas which is directed downwardly onto the top surface of the fragmented permeable mass of the second region. The hot ignition gas ignites the top surface 42**, forming a primary combustion zone across the top surface at about the same elevation as the combustion zone in the first region of the retort. The primary combustion zone in the retort is now flat and is spread horizontally across the entire fragmented permeable mass in the retort. Thereafter, fuel can be discontinued to the burners while oxygen-supplying gas is continued to the retort for advancing the flat primary combustion zone through the retort.

Alternatively, if desired, once the primary combustion zone in the first region is advanced downwardly and reaches an elevation in the retort at about the elevation of the top surface 42 of the second region, the cooling fluid is discontinued through the passages **34*b***. By discontinuing introduction of fluid through these passages, the primary combustion zone can spread by convection from the first region laterally outwardly through the second region to the outer boundaries of the retort.

Once the primary combustion zone has spread across the second region of the retort, the combustion zone is substantially flat in a horizontal plane across the extent of the retort. As described above, the air or other oxygen-supplying gas can thereafter be continued to the retort for advancing the flat primary combustion zone downwardly through the retort during retorting operations.

The above description of methods for igniting an in situ oil shale retort in a subterranean formation containing oil shale are for illustrative purposes. Because of variations which will be apparent to those skilled in the art, the present invention is not intended to be limited to the particular embodiments described hereinabove. The scope of the invention is defined in the following claims.

What is claimed is:

1. A method for igniting a fragmented permeable mass of formation particles containing oil shale in an in situ oil shale retort formed in a subterranean formation containing oil shale, comprising the steps of:

(a) establishing a combustion zone at about the top surface of a first region of the fragmented permeable mass of formation particles, the top surface of the first region located at a first elevation in the retort;

(b) introducing a retort inlet mixture comprising an oxygen-supplying gas into the retort for advancing the combustion zone downwardly through the first region of the fragmented permeable mass of formation particles to a second elevation in the retort below the first elevation; and then (c) igniting the top surface of a second region of the fragmented permeable mass of formation particles at about the second elevation, the second region being spaced apart laterally from the first region for spreading the combustion zone laterally across the fragmented permeable mass of formation particles at about the second elevation in the retort.

2. The method according to claim 1 comprising the additional step of introducing a cooling gas into such a second region for inhibiting lateral spreading of the combustion zone until the combustion zone has advanced downwardly to the second elevation in the retort.

3. The method according to claim 1 wherein the in situ oil shale retort comprises a top boundary of overlying unfragmented formation and a void space remaining between the top surface of the fragmented permeable mass of formation particles and the overlying unfragmented formation, the method comprising the additional steps of:

(a) forming at least one borehole through the overlying unfragmented formation into the void space;

(b) inserting a pipe through such a borehole, the bottom end of the pipe extending into the void space, forming an annulus between the outer surface of the pipe and the wall of such a borehole;

(c) introducing a combustible mixture of oxygen-supplying gas and fuel through such a pipe and igniting the combustible mixture for providing hot ignition gases flowing from the pipe into the fragmented permeable mass of formation particles for establishing the combustion zone at about the top surface of the first region of the fragmented permeable mass of formation particles; and (d) introducing a cooling fluid into the void space through the annulus.

4. The method according to claim 3 comprising introducing air into the void space through the annulus for cooling at least a portion of such overlying unfragmented formation and for preventing accumulation of an explosive mixture of gas in such a void space.

5. A method for igniting an in situ oil shale retort in a subterranean formation containing oil shale, the in situ retort containing a fragmented permeable mass of formation particles containing oil shale, and having a top surface of the fragmented mass with an upper elevation region and a lower elevation region spaced laterally from the upper elevation region, comprising the steps of:

(a) igniting a combustion zone in an upper elevation region of the top surface of the fragmented mass;

(b) advancing the combustion zone downwardly through the fragmented mass from the upper elevation region; and (c) spreading the combustion zone laterally across a lower elevation region of the top surface of the fragmented mass for establishing a generally horizontally extending combustion zone across substantially the entire horizontal cross-section of the fragmented mass.

6. The method according to claim 5 comprising the additional step of successively igniting a top surface of the fragmented mass at successively lower elevations.

7. The method according to claim 5 comprising the additional step of inhibiting premature lateral spreading of the combustion zone by introducing a cooling gas into such lateral regions.

8. A method for igniting a fragmented permeable mass of formation particles containing oil shale in an in situ oil shale retort in a subterranean formation containing oil shale, the in situ oil shale retort having a void space between a top boundary of overlying unfragmented formation and the top surface of the fragmented permeable mass of formation particles, comprising the steps of:

(a) introducing a combustible mixture of fuel and an oxygen-supplying gas into a passage formed through the overlying unfragmented formation generally above a first region of the fragmented permeable mass, the top surface of such a first region being at a first elevation in the retort;

(b) igniting the combustible mixture for providing a hot ignition gas contacting formation particles at the top surface of such a first region for forming a combustion zone in such a first region; thereafter (c) introducing a combustible mixture of fuel and oxygen-supplying gas into a passage formed through the overlying unfragmented formation generally above a second region of the fragmented permeable mass, the second region having a top surface at a second elevation in the retort lower than the first elevation and spaced apart laterally from the first region; and (d) igniting the combustible mixture for providing a hot ignition gas contacting formation particles at the top surface of such a second region for spreading the combustion zone laterally across the retort.

9. The method according to claim 8 comprising the step of advancing the combustion zone from the first elevation to the second elevation and thereafter spreading the combustion zone laterally across the retort at such a second elevation.

10. The method according to claim 8 comprising the additional step of introducing a pipe into the passage generally above the first region of the fragmented permeable mass, forming an annulus between the pipe and the passage, and introducing a cooling gas into the annulus for cooling overlying unfragmented formation.

11. The method according to claim 8 comprising introducing air into the annulus for cooling overlying unfragmented formation.

12. The method according to claim 8 or 10 comprising the additional step of introducing a pipe into the passage generally above the second region of such a fragmented permeable mass, forming an annulus between the pipe and the passage and introducing air into the annulus for cooling overlying unfragmented formation.

13. A method of igniting an in situ oil shale retort in a subterranean formation containing oil shale, the in situ oil shale retort containing a fragmented permeable mass of formation particles containing oil shale, comprising the steps of:

(a) introducing a hot ignition gas into a first region of the fragmented permeable mass of formation particles for forming a combustion zone in such a first region;

(b) introducing a cooling fluid into a second region of the fragmented permeable mass of formation particles, laterally spaced apart from the first region, for inhibiting lateral spreading of the combustion zone; and thereafter (c) reducing the amount of cooling fluid introduced into such a second region for spreading the combustion zone laterally across the in situ oil shale retort.

14. The method according to claim 13 comprising introducing air into such a second region of the fragmented permeable mass of formation particles for inhibiting lateral spreading of the combustion zone.

15. The method according to claim 13 comprising forming the combustion zone in such a first region at a first elevation in the retort, introducing an oxygen-supplying gas into the first region for advancing the combustion zone downwardly through such a first region to a second elevation in the retort, and thereafter spreading the primary combustion zone laterally across the in situ oil shale retort at about the second elevation.

16. A method of forming a generally flat primary combustion zone in a fragmented permeable mass of formation particles containing oil shale in an in situ oil shale retort, the in situ oil shale retort having a top boundary of unfragmented formation overlying the retort, and a void space remaining between the top surface of the fragmented permeable mass of formation particles and the top boundary, the top surface of a first region of the fragmented permeable mass of formation particles being at a higher elevation in the retort and the top surface of a second region of the fragmented permeable mass of formation particles being at a lower elevation in the retort, the second region spaced laterally from the first region, comprising the steps of:

(a) drilling at least one borehole through formation overlying the first region of such a fragmented mass and drilling at least one borehole through unfragmented formation overlying the second region of such a fragmented mass;

(b) introducing a combustible mixture of fuel and an oxygen-supplying gas into such a borehole drilled through unfragmented formation overlying the first region;

(c) igniting such a combustible mixture and directing hot ignition gas from combustion into the first region of the fragmented permeable mass for forming a combustion zone at the higher elevation in the retort;

(d) discontinuing introduction of fuel, while continuing introduction of air, for advancing the combustion zone downwardly through the first region to the lower elevation in the retort; and (e) spreading the combustion zone laterally through the second region at about the lower elevation in the retort by introducing a combustible mixture of fuel and an oxygen-supplying gas into such a borehole formed through formation overlying the second region, igniting the combustible mixture and directing hot ignition gas from combustion into the fragmented permeable mass of the second region.

17. The method according to claim 16 comprising the additional steps of extending a pipe through such a borehole drilled through formation overlying the first region and extending a pipe through such a borehole drilled through formation overlying the second region, forming an annulus between the pipes and the walls of the boreholes, introducing the combustible mixture of fuel and oxygen-supplying gas into the pipes and introducing air through the annuli formed between the pipes and walls of the boreholes for cooling the top boundary of unfragmented formation.

18. The method according to claim 16 comprising the additional step of introducing the combustible mixture of fuel and oxygen-supplying gas into a burner positioned in such a borehole.

19. The method according to claim 16 comprising the step of introducing air through at least one of the boreholes formed through formation overlying the second region during the time that the combustion zone is advancing from the higher elevation downwardly to the lower elevation for inhibiting lateral spreading of the combustion zone.

20. A method of igniting a fragmented permeable mass of formation particles containing oil shale in an in situ oil shale retort formed in a subterranean formation containing oil shale, there being a subterranean base of operation located above such an in situ oil shale retort for providing effective access across substantially the entire horizontal extent of the retort, the retort having a top boundary, four vertically extending side boundaries, and a bottom boundary of unfragmented formation, wherein a void space is located between the top surface of the fragmented permeable mass of formation particles and overlying unfragmented formation, and a sill pillar of unfragmented formation extending between the top boundary of the retort and the floor of the subterranean base of operation, the method comprising the steps of:

(a) forming at least one borehole through the sill pillar of unfragmented formation from the base of operation, such a borehole located generally above a first region of the fragmented permeable mass of formation particles having a top surface at a first elevation in the retort;
(b) forming at least one borehole through the sill pillar of unfragmented formation from the base of operation, such a borehole located generally above a second region of the fragmented permeable mass of formation particles, the second region spaced apart laterally from the first region and having a top surface at a second elevation in the retort;
(c) inserting a pipe through each of a plurality of such boreholes, forming an annulus between the outer surface of such a pipe and the wall of such a borehole;
(d) lowering a burner into a pipe in a borehole generally above the first region and introducing a combustible mixture of fuel and air to the burner;
(e) igniting the combustible mixture of fuel and air for providing hot ignition gases flowing from the pipe into the first region of the fragmented permeable mass of formation particles for establishing a primary combustion zone at the top surface of such a first region;
(f) introducing air into the void space through the annulus between the outer surface of the pipe and the wall of the borehole located generally above such a first region for cooling at least a portion of the overlying unfragmented formation;
(g) introducing air into the retort through at least one borehole located generally above the second region of the fragmented permeable mass for inhibiting lateral spreading of the primary combustion zone from the first region into the second region;
(h) discontinuing introduction of the combustible mixture of fuel and air to the burner while continuing introduction of air for advancing the primary combustion zone downwardly through the first region to a second elevation in such an in situ oil shale retort;
(i) lowering a burner into a pipe generally above the second region and introducing a combustible mixture of fuel and air to such a burner; and
(j) igniting the combustible mixture of fuel and air for providing hot ignition gases flowing from the pipe into the second region of the fragmented permeable mass of formation particles for spreading the primary combustion zone laterally at the second elevation through such a second region of the fragmented permeable mass.

21. The method according to claim 20 additionally comprising the step of forming a secondary combustion zone in the first region for spreading the primary combustion zone laterally.

22. A method of igniting a fragmented permeable mass of formation particles containing oil shale in an in situ oil shale retort in a subterranean formation containing oil shale, the in situ oil shale retort having a top boundary of overlying unfragmented formation, the top surface of the fragmented permeable mass having an upper elevation region and a lower elevation region spaced laterally from the upper elevation region, the method comprising the steps of:

(a) establishing a primary combustion zone across substantially the entire top surface of the fragmented permeable mass;
(b) advancing the combustion zone downwardly through the fragmented mass at a relatively faster rate below the upper elevation region; and
(c) advancing the primary combustion zone downwardly through the fragmented mass at a relatively slower rate below the lower elevation region until a reasonably flat horizontally extending primary combustion zone is established in the fragmented mass.

23. The method according to claim 22 comprising the step of retarding the advance of the primary combustion zone by establishing a secondary combustion zone upstream from the primary combustion zone in at least some regions of the fragmented mass.

24. The method according to claim 22 comprising retarding the advance of the primary combustion zone by adjusting the oxygen concentration of a gas introduced into the primary combustion zone.

25. A method of igniting a fragmented permeable mass of formation particles containing oil shale in an in situ oil shale retort in a subterranean formation containing oil shale, the in situ oil shale retort having a top boundary of overlying unfragmented formation, the top surface of the fragmented permeable mass having a higher elevation region in a first region of the retort and a lower elevation region in a second region of the retort, the lower elevation region spaced apart laterally from the higher elevation region, the method comprising the steps of:

(a) forming a primary combustion zone across substantially the entire top surface of the fragmented permeable mass;
(b) introducing a retort inlet mixture comprising an oxygen-supplying gas for advancing such a primary combustion zone downwardly through the fragmented permeable mass; and
(c) forming a secondary combustion zone in the fragmented permeable mass in the second region of the retort upstream from the primary combustion zone for slowing the downward advance of the primary combustion zone in the second region.

26. The method according to claim 25 comprising the additional steps of:

(a) forming at least one borehole through the overlying unfragmented formation into the void space remaining between the top surface of the fragmented permeable mass of formation particles and the top boundary of overlying unfragmented formation;
(b) inserting a pipe through such a borehole, forming an annulus between the outer surface of the pipe and the wall of the borehole;
(c) introducing a combustible mixture of air and fuel through such a pipe and igniting the combustible mixture for providing hot ignition gases flowing from the pipe into the fragmented permeable mass of formation particles, for forming the primary combustion zone across substantially the entire top surface of the fragmented permeable mass; and (d) introducing air through the annulus into the void space for cooling at least a portion of the overlying unfragmented formation.

27. The method according to claim 25 comprising maintaining the secondary combustion zone until the primary combustion zone is generally flat in a horizontal plane across the entire extent of the retort.

28. The method according to claim 26 comprising the additional step of inserting a burner into such a pipe and introducing the combustible mixture of air and fuel to the burner.

29. A method of igniting a fragmented permeable mass of formation particles containing oil shale in an in situ oil shale retort formed in a subterranean formation containing oil shale, the in situ oil shale retort having a top boundary of overlying unfragmented formation, generally vertically extending side boundaries of unfragmented formation, and a bottom boundary of unfragmented formation, a void space remaining between the top surface of the fragmented permeable mass of formation particles and the top boundary of overlying formation, the method comprising the steps of:

(a) forming at least one borehole through the overlying unfragmented formation;

(b) introducing a combustible mixture of fuel and air through such a borehole and igniting the combustible mixture to provide a hot ignition gas for forming a primary combustion zone substantially across the entire top surface of the fragmented permeable mass of formation particles, the primary combustion zone being at a first elevation in a first region of the retort and at a second elevation in a second region;

(c) discontinuing introduction of fuel;

(d) introducing oxygen-supplying gas for advancing the primary combustion zone downwardly through the fragmented mass; thereafter (e) re-introducing fuel into the second region of the fragmented permeable mass for forming a secondary combustion zone for slowing the advance of the primary combustion zone in the second region; and (f) thereafter discontinuing introduction of fuel to the retort.

30. The method according to claim 29 comprising the additional steps of:

(a) inserting a pipe through such a borehole so that the bottom of the pipe extends into the void space, forming an annulus between the outer surface of the pipe and the wall of the borehole; and (b) introducing the combustible mixture of fuel and air into the pipe and, additionally, introducing air into the annulus for cooling the top boundary of overlying unfragmented formation.

31. A method of igniting a fragmented permeable mass of formation particles containing oil shale in an in situ oil shale retort formed in a subterranean formation containing oil shale, the top surface of the fragmented permeable mass having a higher elevation region in a first region of the retort and at a lower elevation region in a second region of the retort, the second region spaced apart laterally from such a first region, there being a subterranean base of operation located above the retort for providing effective access across substantially the entire horizontal extent of the retort, the retort having a top boundary, four vertically extending side boundaries, and a bottom boundary of unfragmented formation, wherein a void space remains between the top surface of the fragmented permeable mass of formation particles and overlying unfragmented formation, a sill pillar of unfragmented formation extending between the top boundary and the floor of the subterranean base of operation, the method comprising the steps of:

(a) forming a plurality of horizontally spaced apart boreholes through the sill pillar of unfragmented formation from the base of operation;

(b) inserting a pipe into each of at least a portion of such horizontally spaced apart boreholes so that the bottom end of the pipe extends into the void space, forming an annulus between the outer surface of the pipe and the wall of the borehole;

(c) lowering a burner into each of a plurality of such pipes and introducing a combustible mixture of fuel and air to such burners;

(d) igniting the combustible mixture of fuel and air for providing hot ignition gases flowing from such a pipe into the fragmented permeable mass of formation particles for forming a primary combustion zone across substantially the entire top surface of the fragmented permeable mass of formation particles;

(e) introducing air into such an annulus for cooling at least a portion of the top boundary of the retort;

(f) discontinuing introduction of fuel while continuing introduction of air for advancing the primary combustion zone downwardly through the fragmented permeable mass of formation particles;

(g) thereafter introducing fuel through at least one of the boreholes for forming a secondary combustion zone upstream of such a primary combustion zone in the second region of the retort for slowing the downward advance of the primary combustion zone located in such a second region for flattening the primary combustion zone; and (h) discontinuing introduction of fuel, while continuing introduction of air to advance the flattened primary combustion zone downwardly through the retort.

32. A method for igniting a fragmented permeable mass of formation particles containing oil shale in an in situ oil shale retort formed in a subterranean formation containing oil shale, comprising the steps of:

(a) igniting a combustion zone at the top surface of a first region of the fragmented mass at a first elevation in the retort;

(b) advancing the combustion zone downwardly through the first region of the fragmented mass; and (c) igniting a combustion zone at the top surface of a second region of the fragmented mass spaced laterally from the first region and at a second elevation in the retort lower than the first elevation.

33. The method according to claim 32 comprising the step of igniting the combustion zones at the top surface of the first and second regions of the fragmented mass at about the same time and advancing the combustion zone downwardly through the fragmented mass in the second region at a lower rate than advancement of the combustion zone in the first region until a reasonably flat combustion zone is established.

34. The method according to claim 32 comprising the step of igniting the combustion zone at the top surface of the second region of the fragmented mass at a time when the combustion zone in the first region of the fragmented mass is at about the second elevation in the retort.

35. A method for establishing a reasonably horizontal combustion zone in a fragmented permeable mass of formation particles that has a non-horizontal upper surface comprising the step of successively igniting regions of the upper surface of the fragmented permeable mass that are spaced apart laterally from each other and at successively lower elevations.

36. A method for igniting a fragmented permeable mass of formation particles containing oil shale in an in situ oil shale retort formed in a subterranean formation containing oil shale, comprising the steps of:

(a) heating a first region of the fragmented permeable mass for establishing a combustion zone at about the top surface of the first region located at a first elevation in the retort;

(b) introducing oxygen-supplying gas into the first region of the fragmented permeable mass;

(c) heating a second region of the fragmented permeable mass for establishing a combustion zone at about the top surface of the second region and located at a second elevation in the retort; and (d) introducing oxygen-supplying gas into the second region.

37. The method according to claim 36 comprising heating both the first and second regions of the fragmented permeable mass at about the same time and introducing fuel into the retort for establishing a secondary combustion zone in the second region.

38. The method according to claim 36 comprising the step of heating the second region of the fragmented permeable mass when the combustion zone in the first region is at about the second elevation in the retort.

39. A method for igniting a fragmented permeable mass of formation particles containing oil shale in an in situ oil shale retort formed in a subterranean formation containing oil shale, the in situ retort comprising a top boundary of overlying unfragmented formation, a void space remaining between the top surface of the fragmented permeable mass and the overlying unfragmented formation, the method comprising the steps of:

(a) forming at least one borehole through the overlying unfragmented formation into the void space;

(b) inserting a pipe through such a borehole, the bottom end of the pipe extending into the void space, forming an annulus between the outer surface of the pipe and the wall of the borehole;

(c) introducing a combustible mixture of oxygen-supplying gas and fuel through such a pipe and igniting the combustible mixture for providing hot ignition gases flowing from the pipe into the fragmented permeable mass for establishing a combustion zone at about the top surface of the fragmented permeable mass; and (d) introducing a cooling fluid into the void space through the annulus for cooling at least a portion of such overlying unfragmented formation and for preventing accumulation of an explosive mixture of gas in such a void space.

* * * * *